US010393098B2

(12) United States Patent
Shen et al.

(10) Patent No.: US 10,393,098 B2
(45) Date of Patent: Aug. 27, 2019

(54) TWO-WAY WOBBLE PLATE COMPRESSOR

(71) Applicant: BITZER Refrigeration Technology (China) Co., Ltd., Beijing (CN)

(72) Inventors: Dazi Shen, Beijing (CN); Jian Wang, Beijing (CN); Yujun Chen, Beijing (CN)

(73) Assignee: BITZER Refrigeration Technology (China) Co., Ltd., Beijing (CN)

( * ) Notice: Subject to any disclaimer, the term of this patent is extended or adjusted under 35 U.S.C. 154(b) by 61 days.

(21) Appl. No.: 15/312,454

(22) PCT Filed: May 21, 2015

(86) PCT No.: PCT/CN2015/079444
§ 371 (c)(1),
(2) Date: Nov. 18, 2016

(87) PCT Pub. No.: WO2015/176666
PCT Pub. Date: Nov. 26, 2015

(65) Prior Publication Data

US 2017/0089329 A1 Mar. 30, 2017

(30) Foreign Application Priority Data

May 21, 2014 (CN) ..... 2014 1 02157835

(51) Int. Cl.
*F04B 27/08* (2006.01)
*F04B 27/12* (2006.01)
*F04B 27/10* (2006.01)

(52) U.S. Cl.
CPC ..... *F04B 27/12* (2013.01); *F04B 27/0878* (2013.01); *F04B 27/0895* (2013.01);
(Continued)

(58) Field of Classification Search
CPC .. F04B 27/1063; F04B 27/12; F04B 27/0878; F04B 27/1045; F04B 27/0895; F16H 23/04
See application file for complete search history.

(56) References Cited

U.S. PATENT DOCUMENTS 1,978,762 A * 10/1934 Reagan ..... F16H 23/04 74/60
2,335,415 A 11/1943 Holmes
(Continued)

FOREIGN PATENT DOCUMENTS

CN 1141393 A 1/1997
CN 1199144 A 11/1998
(Continued)

*Primary Examiner* — Abiy Teka
(74) *Attorney, Agent, or Firm* — Reinhart Boerner Van Deuren P.C.

(57) ABSTRACT

A two-way wobble plate compressor, comprising: a cylinder block (100); a two-way piston (200) capable of reciprocating within a cylinder bore (110) of the cylinder block (100); a drive assembly (300) driving the two-way piston (200), the drive assembly (300) including a drive shaft (310), a rotor (320) fixedly connected with the drive shaft (310), and an annular wobble plate (330) fitting with the rotor (320); the rotor (320) has an inner surface (323) for fitting with the annular wobble plate (330), the inner surface (323) include a first inner surface (324) and a second inner surface (325), which are oppositely arranged, and a rotor contact surface (326); the wobble plate (330) is partially encircled within the inner surface (323) of the rotor (320), and includes a first peripheral portion (334), a second peripheral portion (335), and a wobble plate contact surface (336); a first bearing (340) is provided between the first inner surface (324) and the first peripheral portion (334), a second bearing (350) is provided between the second inner surface (325) and the second peripheral portion (335), and a third bearing (360) is
(Continued)

provided between the rotor contact surface (326) and the wobble plate contact surface (336). The two-way wobble plate compressor of the present invention may significantly reduce friction loss.

10 Claims, 7 Drawing Sheets

(52) U.S. Cl.
CPC ..... *F04B 27/10* (2013.01); *F04B 27/1045* (2013.01); *F04B 27/1063* (2013.01)

(56) References Cited

U.S. PATENT DOCUMENTS

| | | | | |
|---|---|---|---|---|
| 4,166,342 | A * | 9/1979 | Shaffer | B24B 37/04 451/163 |
| 5,009,574 | A | 4/1991 | Ikeda et al. | |
| 5,239,913 | A | 8/1993 | Terauchi | |

FOREIGN PATENT DOCUMENTS

| | | | |
|---|---|---|---|
| CN | 2787875 | Y | 6/2006 |
| CN | 1878955 | A | 12/2006 |
| CN | 101012819 | A | 8/2007 |
| CN | 101598121 | A | 12/2009 |
| CN | 204099154 | U | 1/2015 |
| JP | 2009068466 | A | 4/2009 |

* cited by examiner

TWO-WAY WOBBLE PLATE COMPRESSOR

TECHNICAL FIELD

The present invention relates to a wobble plate compressor having a two-way piston.

BACKGROUND ART

Traditional compressors include swash plate compressors. Usually, a swash plate type compressor includes a drive shaft, a swash plate connected together with the drive shaft, and several pistons operatively connected with the swash plate. When a drive unit drives the drive shaft to rotate in a well-known manner, the swash plate will bring each piston within cylinders into reciprocating motion.

For example, U.S. Pat. No. 5,009,574 discloses a traditional swash plate compressor, in the structure of which a swash plate is fixedly integrated on a drive shaft, such that the swash plate rotates together with the drive shaft. In other words, the swash plate does not rotate relative to the drive shaft. During the operation of a traditional swash plate compressor, the piston simply performs reciprocating motion. In such a structure, it further includes a sliding shoe, through which the swash plate drives the piston into reciprocating motion. Since the swash plate rotates together with the drive shaft, it causes high speed sliding motion between each sliding shoe and the swash plate.

The characteristic high speed sliding motion between the sliding shoe and the swash plate within the swash plate compressor may result in high friction loss and low loading capacity, and particularly, the circumstances become more serious in large volume compressors. Thus, as an improvement to swash plate compressors, wobble plate compressors in the prior art disengage the motion of the swash plate from the drive shaft, trying to reduce the above described friction loss.

For example, U.S. Pat. No. 2,335,415 discloses a wobble plate compressor structure, and in this structure, a wobble plate is connected to a hub of a drive shaft via an anti-friction bearing, such that the wobble plate performs wobbling motion without rotating together with the drive shaft; in other words, there is only slight sliding motion between the wobble plate and the sliding shoe, and sliding friction with high speed motion between the traditional swash plate and the sliding shoe has been replaced by rolling friction of the bearing. However, the structure reduces friction loss, but it is not compact enough, and lacks industrial applicability.

U.S. Pat. No. 5,239,913 discloses another typical wobble plate compressor structure. In this structure, a force from a top of the piston is directed to a bearing via a connecting rod and the wobble plate; for compressors using a single-way piston, such a wobble plate structure is conventionally usable, however, for larger volume compressors requiring a two-way piston, this structure is obviously not suitable, because there is totally no sufficient space for mounting the bearing and the connecting rod at a same position.

In addition, in this and similar structures, the wobble plate is connected with each piston via a piston rod. Thus, in this piece of prior art, it essentially requires a wobble plate stopper to stop the wobble plate from rotating, which makes the compressor structure complicated, resulting in a uneven or unbalanced, complicated manner of rotation, which in turn produces vibrations and noises.

Thus, a novel wobble plate compressor structure is needed, which may, at the same time of maintaining its applicable range, reduce friction loss, improve energy conversion efficiency, and meanwhile overcome the above described problems of existing wobble plate structures.

SUMMARY OF THE INVENTION

An object of the present invention is to overcome the above described disadvantages of the existing wobble plate compressor structures, thereby providing a novel wobble plate compressor structure with low friction loss, and improved energy conversion ratio.

In order to achieve the above described object, the present invention provides a two-way wobble plate compressor, comprising:

a cylinder block, the cylinder block having a cylinder bore;

a two-way piston capable of reciprocating within the cylinder bore of the cylinder block;

a drive assembly driving the two-way piston, the drive assembly including a drive shaft, a rotor fixedly connected with the drive shaft, and an annular wobble plate fitting with the rotor, the rotor having a central plane angled to a perpendicular plane of the drive shaft, the central plane of the wobble plate being coincident with the central plane of the rotor, when the drive shaft rotates, the rotor drives the two-way piston via the wobble plate to perform reciprocating motion; particularly, the rotor has an inner surface for fitting with the annular wobble plate, the inner surface including a first inner surface and a second inner surface, which are oppositely arranged, and a rotor contact surface arranged between the first inner surface and the second inner surface;

the wobble plate is partially encircled within the inner surface of the rotor, and includes respectively a first peripheral portion adjacent to the first inner surface, a second peripheral portion adjacent to the second inner surface and opposite to the first peripheral portion, and a wobble plate contact surface adjacent to the rotor contact surface and arranged between the first peripheral portion and the second peripheral portion;

wherein a first bearing is provided between the first inner surface and the first peripheral portion, a second bearing is provided between the second inner surface and the second peripheral portion, and a third bearing is provided between the rotor contact surface and the wobble plate contact surface.

Alternatively, an inner ring contact surface and an outer ring contact surface of said first bearing are respectively in contact with the first inner surface and the first peripheral portion;

An inner ring contact surface and an outer ring contact surface of said second bearing are respectively in contact with the second inner surface and the second peripheral portion; and An inner ring contact surface and an outer ring contact surface of said third bearing are respectively in contact with the rotor contact surface and the wobble plate contact surface.

Preferably, a thrust washer is provided between the inner ring contact surface of said first bearing and said first inner surface, and/or between the outer ring contact surface of said first bearing and said first peripheral portion; and A thrust washer is provided between the inner ring contact surface of said second bearing and said second inner surface, and/or between the outer ring contact surface of said second bearing and said second peripheral portion.

Said first bearing and the second bearing each is one of a needle roller thrust bearing, a roller pin thrust bearing, alternatively a double row needle roller thrust bearing, a double row roller pin thrust bearing, and a conical roller thrust bearing.

Said third bearing is one of a radial needle roller bearing, alternatively a radial roller pin bearing, or a radial ball bearing.

Preferably, a thrust washer is provided between the inner ring contact surface of said second bearing and said second surface, and between the outer ring contact surface of said second bearing and said second peripheral portion, and said third bearing is a radial ball bearing.

Preferably, said two-way piston includes two socket portions, two hemispherical sliding shoes are provided within the two socket portions for interacting with the first peripheral portion and the second peripheral portion of said wobble plate, respectively.

Preferably, said rotor includes a first annular flange and a second annular flange, and the first annular flange and the second annular flange are fastened together via a nut and said drive shaft.

As compared with the prior art, the wobble plate compressor of the present invention is of a compact structure with low design complexity, which improves efficiency and output power, and at the same time, cost can be successfully controlled, so it is suitable for application in commercial compressors.

DETAILED DESCRIPTION OF THE EMBODIMENTS

With reference to particular embodiments and corresponding drawings, the structure composition and the operating principles of a two-way wobble plate compressor of the present invention will be described in detail in the following.

Generally speaking, the two-way wobble plate compressor of the present invention adopts a two-way piston structure, which uses a wobble plate to drive a two-way piston to reciprocate, and motion of the wobble plate is driven by a rotor fixed on a drive shaft. The present invention is particularly characterized by the manner of fitting between the wobble plate and the rotor. Bearing(s) may be fit between the wobble plate and the rotor so as to form a combined bearing unit; in other words, in addition to operating to drive the two-way piston into motion, the wobble plate may also directly serve as the outer ring of the combined bearing unit; and in addition to operating to drive the wobble plate into wobbling motion, the rotor mounted on drive shaft may also directly serve as the inner ring of the combined bearing unit. As such, high speed sliding motion in traditional swash plate compressors is replaced by rolling motion of the combined bearing unit; and meanwhile, as compared with the prior art, the wobble plate compressor of the present invention is of a compact structure with low design complexity, which improves efficiency and output power, and at the same time, cost can be successfully controlled, so it is suitable for application in commercial compressors.

Figure 1:
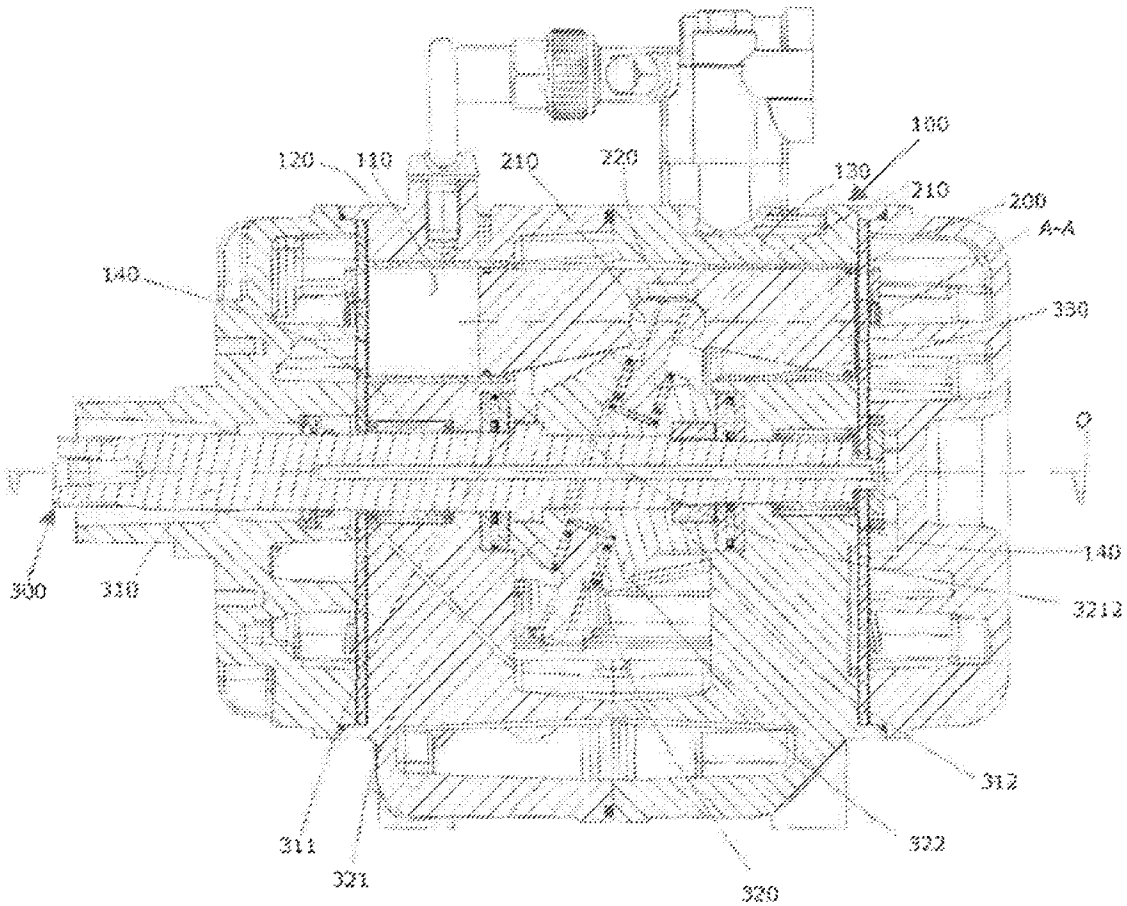
FIG. 1 is a sectional view of an embodiment of a two-way wobble plate compressor of the present invention.

Specifically, in FIG. 1, an illustrative view of an embodiment of a two-way wobble plate compressor of the present invention is shown.

With reference to the drawing, in this embodiment, the two-way wobble plate compressor includes a cylinder block 100, the cylinder block having several cylinder bores 110. Conventionally, the cylinder block 100 consists of a front cylinder block 120 and a rear cylinder block 130, and includes a pair of central holes 140 along a longitudinal axis O-O of the cylinder block; and the cylinder bores 110 are evenly arranged around the central hole 140.

The two-way wobble plate compressor further includes several two-way pistons 200 capable of reciprocating in the cylinder bores 110 of the cylinder block 100. The two-way pistons 200 perform reciprocating motion in relevant cylinder bores 110 of the front cylinder block 120 and the rear cylinder block 130.

Figure 2:
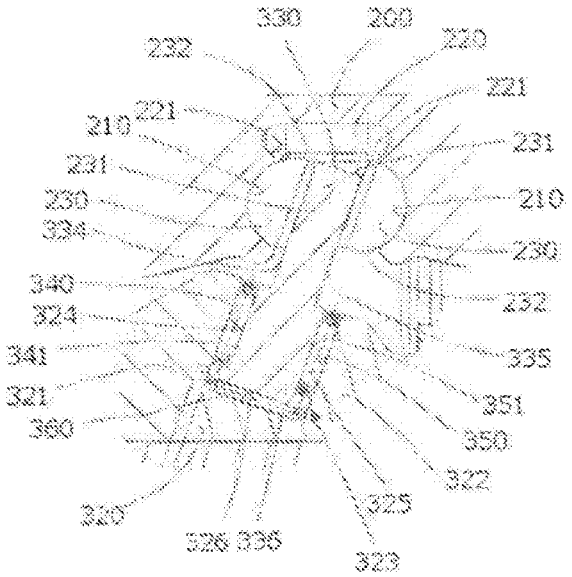
FIG. 2 is a partially enlarged illustrative view of the embodiment of FIG. 1.
Figure 3:
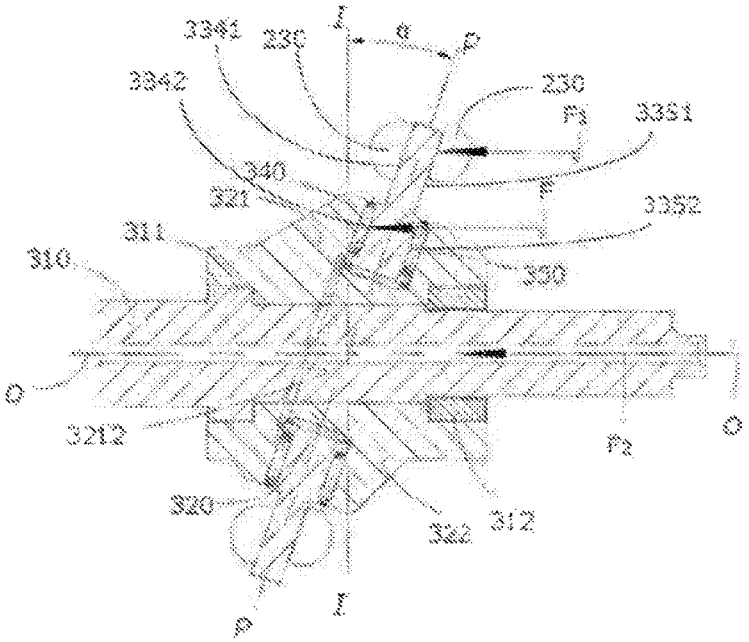
FIG. 3 is another partially enlarged illustrative view of the embodiment of FIG. 1.

The two-way wobble plate compressor further includes a drive assembly 300 driving the two-way pistons 200, the drive assembly 300 including a drive shaft 310, a rotor 320 fixedly connected with the drive shaft 310, and an annular wobble plate 330 fitting with the rotor 320; and further with reference to FIGS. 2 and 3, the rotor 320 has a central plane P-P angled to a perpendicular plane I-I of the drive shaft 310 at an angle of a, the central plane of the wobble plate 330 is coincident with the central plane P-P of the rotor 320, and when the drive shaft 310 rotates, the rotor 320 drives the two-way piston 200 into reciprocating motion via the wobble plate 330.

Conventionally, the drive shaft 310 is rotatably arranged the central hole 140 of the front cylinder block 120 and the rear cylinder block 130, and may be driven into rotation by an external driving force. The rotor 320 is fixedly connected with and integrated on the drive shaft, so it may rotate along with the rotation of the drive shaft 310. Further, with reference to FIGS. 2 and 3, the rotor 320 may conventionally consist of a first annular flange 321 and a second annular flange 322. The first annular flange 321 may be fixed on a boss 311 of the drive shaft 310, and similarly, the second annular flange 322 may be fixed to an engaging surface 3212 of the first annular flange 321 and the drive shaft 310; and the first annular flange 321 and the second annular flange 322 are fastened together via a nut 312 and the drive shaft 310, thereby realizing a fixed connection of the rotor 320 and the drive shaft 310. Of course, in an embodiment of the present invention, the fixed connection of the rotor 320 and the drive shaft 310 may also be implemented in other well known manners.

As described above, the central plane P-P of the rotor 320 and the perpendicular plane I-I of the drive shaft 310 form an included angle α. The included angle determines a stroke length when the two-way piston 200 performs reciprocating motion.

Particularly, with reference to FIGS. 2 and 3, the rotor 320 has an inner surface 323 for fitting with the wobble plate 330; in the embodiment, two inner surfaces 323 are provided between the first annular flange 321 and the second annular flange 322. The inner surface 323 include a first inner surface 324 and a second inner surface 325, which are oppositely arranged, and a rotor contact surface 326 arranged between the first inner surface 324 and the second inner surface 325.

The wobble plate 330 is partially encircled within the inner surface 323 of the rotor 320, and includes respectively a first peripheral portion 334 adjacent to the first inner surface 324, a second peripheral portion 335 adjacent to the second inner surface 325 and opposite to the first peripheral portion 334, and a wobble plate contact surface 336 adjacent to the rotor 320 contact surface and arranged between the first peripheral portion 334 and the second peripheral portion 335.

As a most prominent feature of the present invention, a first bearing 340 is provided between the first inner surface 324 and the first peripheral portion 334; a second bearing 350 is provided between the second inner surface 325 and the second peripheral portion 335; and a third bearing 360 is provided between the rotor contact surface 326 and the wobble plate contact surface 336.

More specifically, as shown in FIG. 3, the first peripheral portion 334 of the wobble plate 330 includes an upper surface 3341 and a lower surface 3342 arranged on an upper portion of the wobble plate, and correspondingly, the second peripheral portion 335 of the wobble plate 330 includes an upper surface 3351 and a lower surface 3352 arranged on the upper portion of the wobble plate. As shown in the figures, specifically, the first bearing 340 is arranged between the first inner surface 324 and the lower surface 3342 of the first peripheral portion, and the second bearing 350 is arranged between the second inner surface 325 and the lower surface 3252 of the second peripheral portion. In the illustrated embodiment, the upper surface 3341 and the lower surface 3342 of the first peripheral portion 334, and the upper surface 3351 and the lower surface 3352 of the second peripheral portion 335 are respectively arranged in different planes, that is to say, the first peripheral portion 334 and the second peripheral portion 335 are respectively a stepped surface. However, it will be easily understood that, their respective upper surface and lower surface may be alternatively arranged in a same plane.

As shown in FIGS. 1, 2, and 3, in an embodiment of the present invention, the first bearing 340 directly acts on the first inner surface 324 and the first peripheral portion 334; the second bearing 350 directly acts on the second inner surface 325 and the second peripheral portion 335; and the third bearing 360 directly acts on the rotor contact surface 326 and the wobble plate contact surface 336. In other words, for the first bearing 340, the first bearing 340 includes an outer ring contact surface 341 and an inner ring contact surface, and its outer ring contact surface 341 and the first peripheral portion 334 of the wobble plate 330 coincide, and its inner ring contact surface and the first inner surface 324 of the rotor 320 inner surface 323 coincide; for the second bearing 350, its outer ring contact surface 351 and the second peripheral portion 335 of the wobble plate 330 coincide, and its inner ring contact surface and the second inner surface 325 of the rotor 320 inner surface 323 coincide; and for the third bearing 360, its outer ring contact surface and the wobble plate contact surface 336 of the wobble plate 330 coincide, and its inner ring contact surface and the rotor contact surface 326 of the rotor 320 inner surface 323 coincide.

With reference to FIGS. 1, 2, and 3, traditional sliding shoe fitting structure may be adopted for the fittingly driving of the wobble plate 330 and the two-way piston 200. Specifically, the two-way piston 200 includes a plurality of socket portions 210, each socket portion 210 being a hemispherical concave surface respectively provided along an axial direction A-A of the two-way piston 200 and the front and rear walls 221 of the slot 220 at a middle portion of the two-way piston 200. Further, two hemispherical sliding shoes 230 are respectively provided in the socket portions 210 for interacting with the first peripheral portion 334 and the second peripheral portion 335 of the wobble plate 330. Specifically, the two hemispherical sliding shoes 230 are respectively interacting with the wobble plate 330 via the upper surface 3341 of the first peripheral portion 334 and the upper surface 3351 of the second peripheral portion 335. Conventionally, a flat part of the hemispherical sliding shoe 230 is defined as a flat portion 231, and a projected surface part is defined as a convex portion 232; and the sliding shoe 230 may serve as a pivot bearing part between the peripheral portion of the wobble plate 330 and the socket portion 210 of the two-way piston 200. Thus, the wobble plate 330 may be spherically hinged to the two-way piston 200 via the socket portion 210 and the hemispherical sliding shoe 230.

Of course, it will be easily understood that, the wobble plate 330 may also drive the two-way piston 200 into reciprocating motion by other conventional fitting means, for example, using a pin structure to implement a fitting connection between the wobble plate 330 and the two-way piston 200.

As such, when the peripheral portion of the wobble plate 330 slidingly passes between two flat portions of a pair of sliding shoes 230, and the sliding shoe 230 is provided between the two-way piston 200 and the wobble plate 330, the two-way piston 200, the sliding shoe 230, and the peripheral portion wobble plate 330 collectively form a universal bearing structure, and in the present embodiment, the universal bearing structure is a sliding shoe universal joint structure.

In the embodiment, when the drive shaft 310 of the wobble plate compressor rotates, the rotor 320 will rotate with the rotation of the drive shaft 310; due to the actions of the first bearing 340, the second bearing 350, and the third bearing 360, the wobble plate 330 performs wobbling motion but does not rotate along with the rotation of the drive shaft; due to the actions of the sliding shoe universal joint, the flat portion of the sliding shoe 230 and the peripheral portion of the wobble plate 330 move up and down with respect to each other in a diameter direction relative to wobble plate 330; and the two-way piston 200 performs forward and rearward reciprocating motion under the constraints of the corresponding cylinder bore in the cylinder block 100. Since there is no constraint on the rotation of the wobble plate 330, when the drive shaft 310 rotates, the wobble plate 330 may also disproportionately and slowly rotate along with the rotation of the drive shaft 310 under the actions of friction forces of the first bearing 340, the second bearing 350, and the third bearing 360, and such rotation will greatly reduce wear between surfaces of the peripheral portion of the wobble plate 330 and the flat portion of the sliding shoe 230.

Further, with reference to FIGS. 2 and 3, a force F1 coming from the two-way piston 200 and acting on the sliding shoe 230 is transmitted to the first bearing 340 and the second bearing 350 via the wobble plate 330, but the force bearing point of F1 falls out of the inner ring contact surfaces 324, 325 of the first bearing 340 and the second bearing 350. In order to prevent such circumstances from happening, a force F2 directed to the centers of the first bearing 340 and the second bearing 350 is applied thereto in advance via tightening of the nut 312, such that the magnitude, direction and force bearing point of a resultant force F of F1 and F2 is changed. This makes it possible to optimally comply with the design and use requirements of the bearings, and may greatly lengthen the service lives of the bearings.

In the above described embodiments, the first bearing 340 and the second bearing 350 are needle roller thrust bearings; however, alternatively, the first bearing and the second bearing each may also be one of a roller pin thrust bearing, a double row needle roller thrust bearing, a double row roller pin thrust bearing, and a conical roller thrust bearing. Similarly, in the above described embodiments, the third bearing 360 is a radial needle roller bearing; however, alternatively, the third bearing 360 may also be a radial roller pin bearing or a radial ball bearing.

Figure 4:
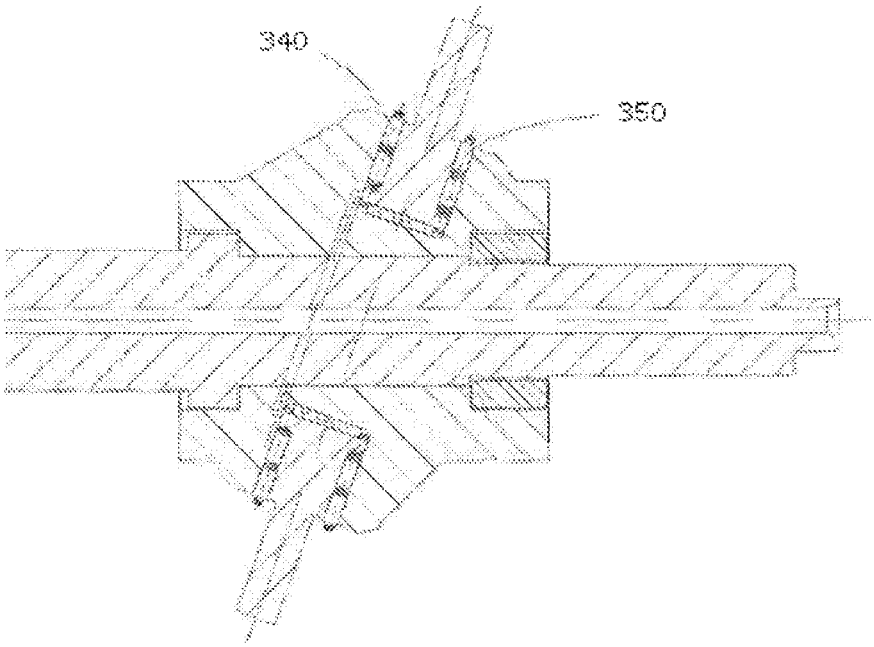
FIG. 4 is an illustrative view of a second embodiment of the present invention, which uses a double row needle roller or double row roller pin thrust bearing.
Figure 5:
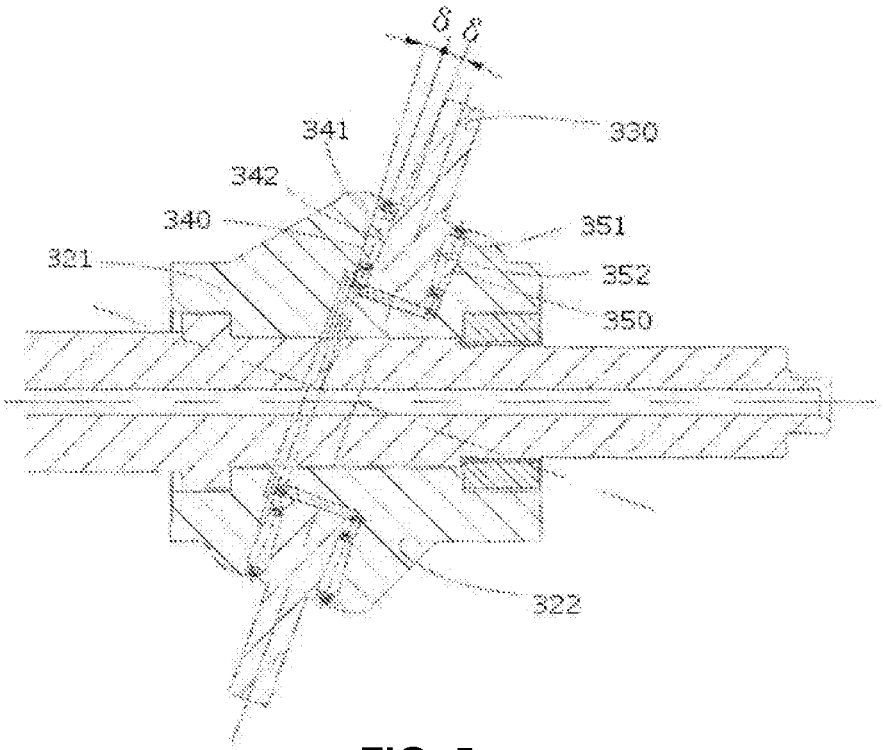
FIG. 5 is an illustrative view of a third embodiment of the present invention, which uses a conical roller thrust bearing.

For example, in the embodiment as shown in FIG. 4, the first bearing 340 and the second bearing 350 are double row needle roller thrust bearings or double row roller pin thrust bearings. In the embodiment as shown in FIG. 5, the first bearing 340 and the second bearing 350 are conical roller thrust bearings. Here, the outer ring contact surfaces 341, 351 and the inner ring contact surfaces 342, 352 of the first bearing 340 and the second bearing 350, both of conical roller thrust bearing type, respectively coincide with two peripheral surfaces of the wobble plate 330 and the first inner surface and the second inner surface of the rotor inner surface, both of which have a same cone angle δ, and a size of the cone angle δ may be determined according to design requirements for the conical roller thrust bearing.

Figure 6:
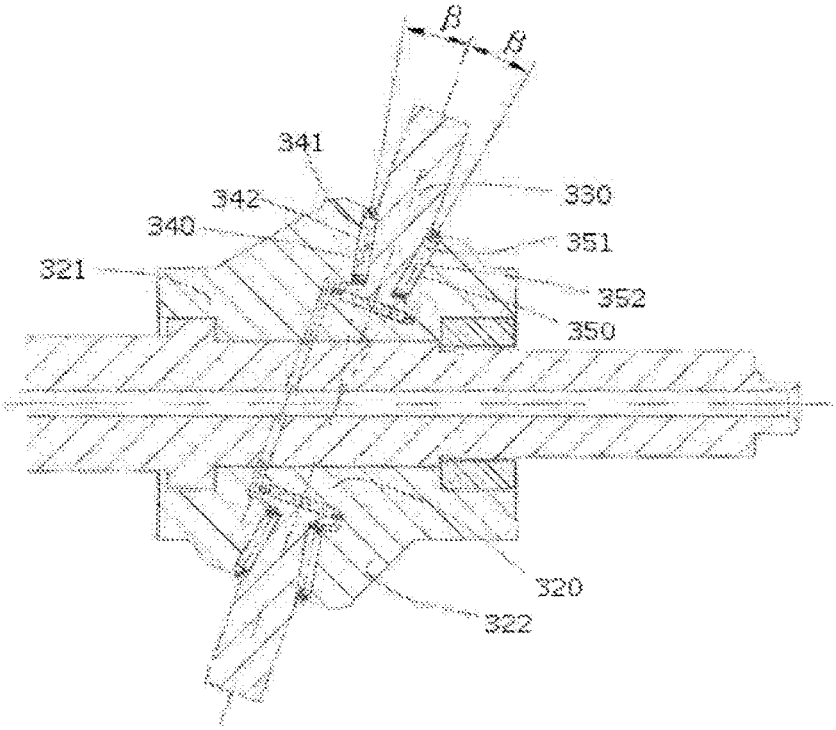
FIG. 6 is an illustrative view of a fourth embodiment of the present invention, which uses an angled needle roller or roller pin thrust bearing.
Figure 7:
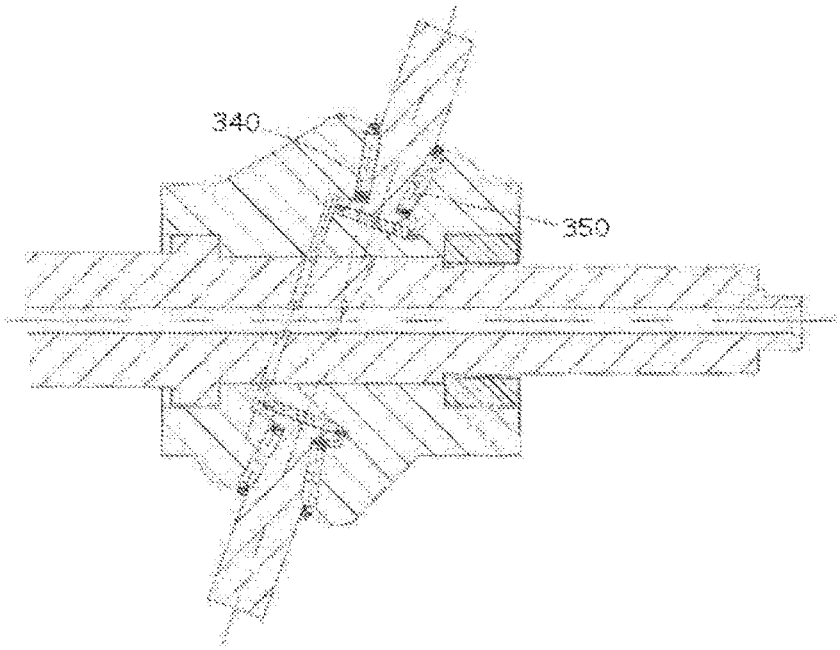
FIG. 7 is an illustrative view of a fifth embodiment of the present invention, which uses an angled double row needle roller or double row roller pin thrust bearing.

As shown in FIG. 6, in another alternative embodiment, the first bearing 340 and the second bearing 350 are similar to those in the first embodiment as shown in FIGS. 1-3, using needle roller thrust bearings or roller pin thrust bearings, however, they differ in the directions of the roller axes. In this embodiment, there is an angle β from 0 degree to ±12 degrees between the roller axis and a central plane of the rotor 320. Considering this design requirements, in the present embodiment, similarly, the outer ring contact surface 341 of the first bearing 340 and the first peripheral portion of the wobble plate 330 coincide, and the inner ring contact surface 342 of the first bearing 340 and the first inner surface of the rotor inner surface coincide, such that the two contact surfaces are parallel relative to the axis of the bearing rollers. FIG. 7 is a variant of the embodiment of FIG. 6, which differs from FIG. 6 in that the first bearing 340 and the second bearing 350 in FIG. 7 are double row needle roller or double row roller pin thrust bearings.

Figure 8:
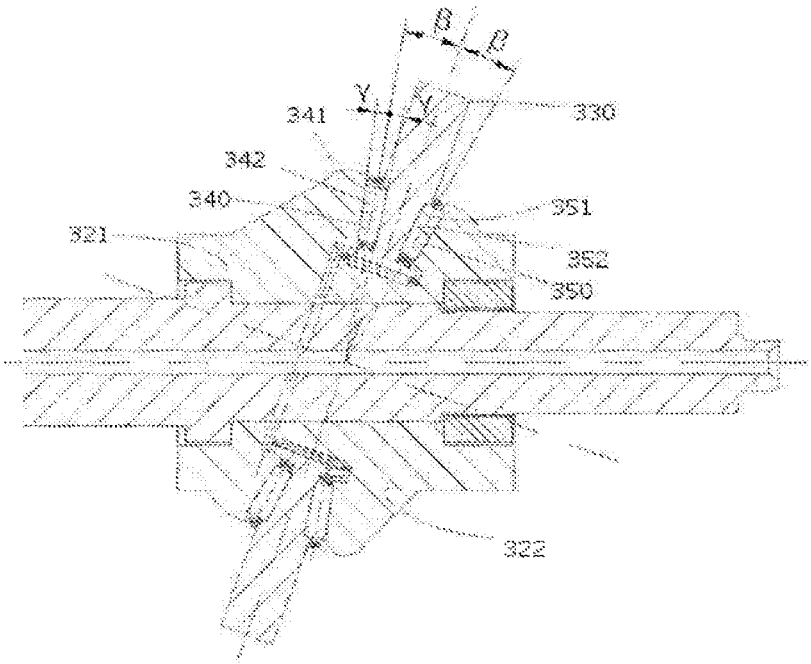
FIG. 8 is an illustrative view of a sixth embodiment of the present invention, which uses a conical roller thrust bearing.

As shown in FIG. 8, as compared with the embodiments of FIGS. 6 and 7, the first bearing 340 and the second bearing 350 may also be implemented as conical roller thrust bearings. In the embodiment, the outer ring contact surfaces 341, 342 and the inner ring contact surfaces 351, 352 of the two conical roller thrust bearing 340, 350 respectively coincide with the two peripheral portions of the wobble plate 330 and the first inner surface and the second inner surface of the rotor inner surface, both of which have a same cone angle γ, and a size of the cone angle γ may be determined according to design requirements for conical roller thrust bearings.

Figure 9:
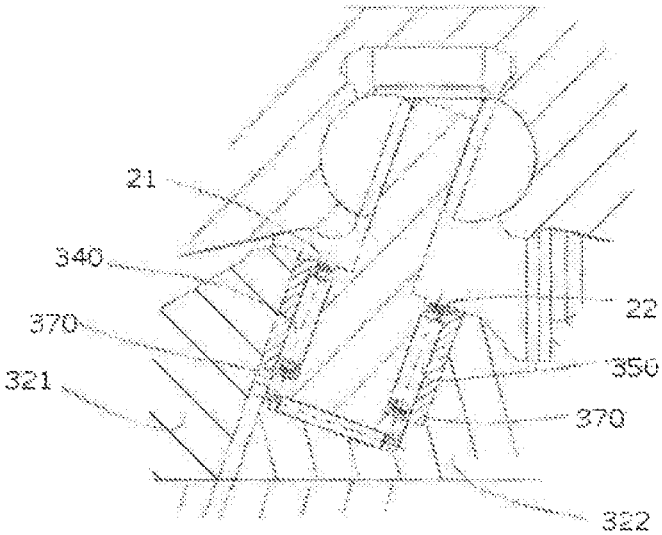
FIG. 9 is an illustrative view of a seventh embodiment of the present invention, which uses a thrust washer on a contact surface at one side of the bearing.
Figure 10:
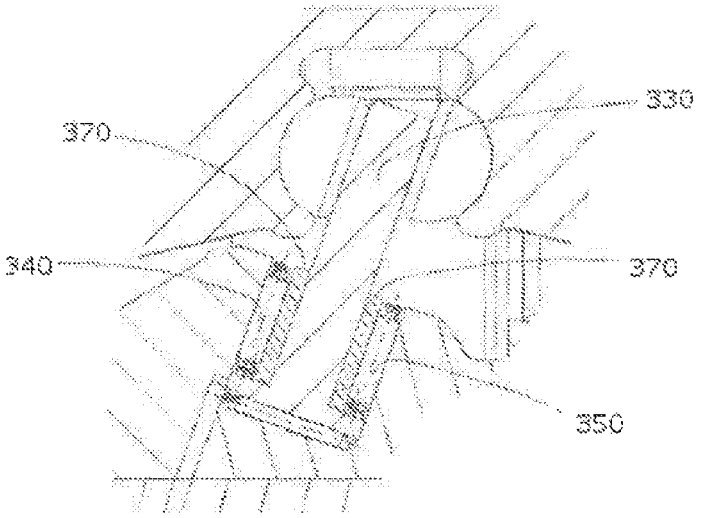
FIG. 10 is an illustrative view of an eighth embodiment of the present invention, which uses a thrust washer on a contact surface at the other side of the bearing.
Figure 11:
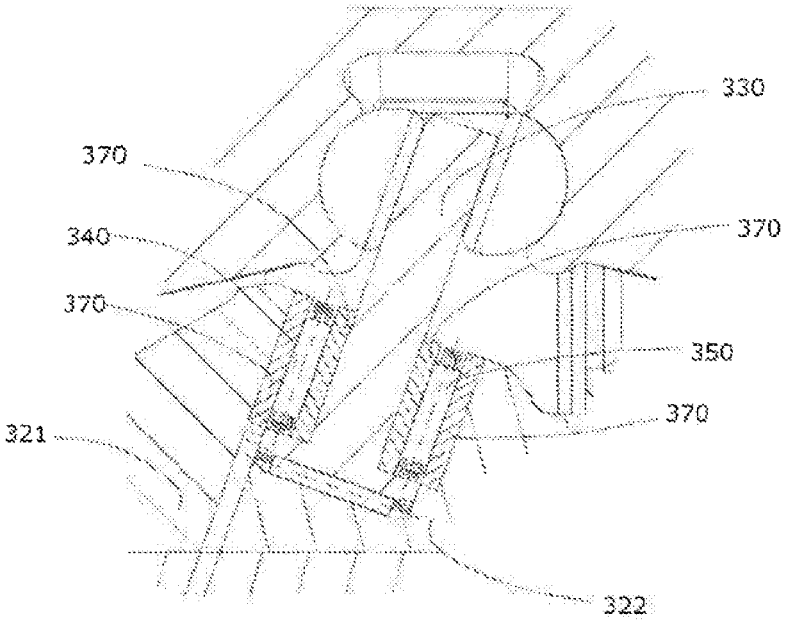
FIG. 11 is an illustrative view of a ninth embodiment of the present invention, which uses a thrust washer on contact surfaces at both sides of the bearing.

Preferably, in an alternative embodiment, a thrust washer is provided between the inner ring contact surface of the first bearing 340 and the first inner surface 324, and/or between the outer ring contact surface of the first bearing 340 and the first peripheral portion 334; and a thrust washer is provided between the inner ring contact surface of the second bearing 350 and the second inner surface 325, and/or between the outer ring contact surface of the second bearing 350 and the second peripheral portion 335. With reference to FIG. 9, a thrust washer 370 is provided between the first bearing 340 and the first inner surface, and between the second bearing 350 and the second inner surface, respectively. The thrust washer 370 is configured such that special treatment on the inner surface of the rotor may be avoided, thereby further reducing cost. With reference to FIG. 10, in the embodiment, a thrust washer 370 is provided between the first bearing 340 and the first peripheral portion of the wobble plate 330, and between the second bearing 350 and the second peripheral portion of the wobble plate 330, respectively. With reference to FIG. 11, in the embodiment, a thrust washer 370 is provided on both an outer side of the two contact surfaces of the first bearing 340 and an outer side of the two contact surfaces of the second bearing 350.

Figure 12:
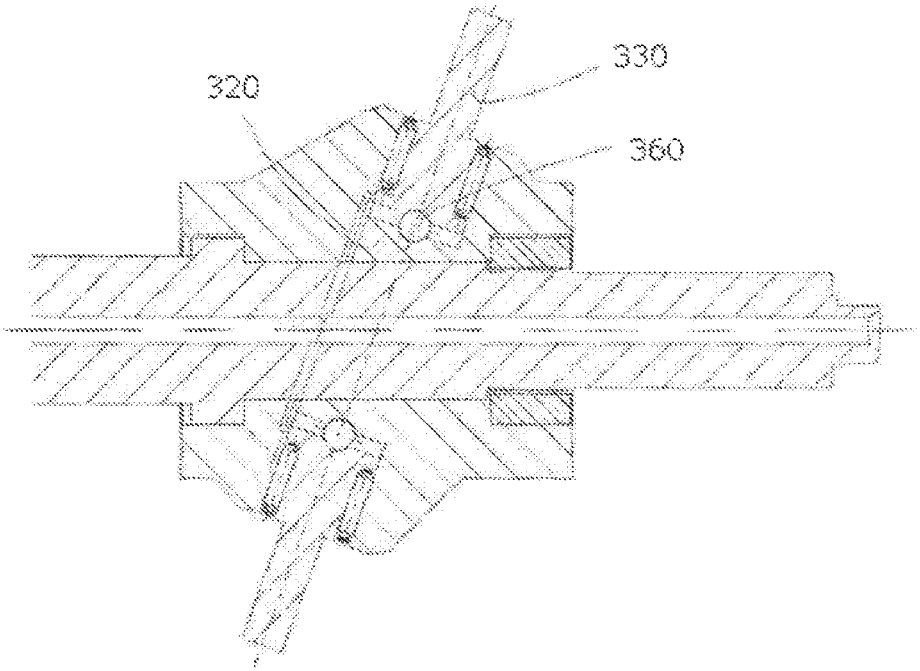
FIG. 12 is an illustrative view of a tenth embodiment of the present invention, which uses a ball bearing.

In addition, with reference to FIG. 12, alternatively, the third bearing 360 may also be a radial ball bearing. In this embodiment, the radial ball bearing is radially arranged between the rotor 320 and the wobble plate 330; in other words, an outer ring runner of the ball bearing is the wobble plate 330 per se, and an inner ring runner of the ball bearing is the rotor 320 per se.

Various examples illustrated in the above may be arbitrarily and suitably combined, and it has been demonstrated in practice that, a most preferable form of combination is: a thrust washer is provided both between the inner ring contact surface of the second bearing and the second surface, and between the outer ring contact surface of the second bearing and the second peripheral portion, and the third bearing is a radial ball bearing.

It will be easily understood that, the present invention is not limited to specific examples given by the above described embodiments, and any combinations and readily conceivable variants of these particular embodiments shall fall into the scope of protection of the present invention.

The invention claimed is:

1. A two-way wobble plate compressor, comprising:

a cylinder block, the cylinder block having a cylinder bore;

a two-way piston capable of reciprocating within the cylinder bore of the cylinder block;

a drive assembly driving the two-way piston, the drive assembly including a drive shaft, a rotor fixedly connected with the drive shaft, and an annular wobble plate fitting with the rotor, the rotor having a central plane angled to a perpendicular plane of the drive shaft, the central plane of the wobble plate being coincident with the central plane of the rotor, when the drive shaft rotates, the rotor drives the two-way piston via the wobble plate to perform reciprocating motion; characterized in that:

the rotor has an inner surface for fitting with the annular wobble plate, the inner surface including a first inner surface and a second inner surface, which are oppositely arranged, and a rotor contact surface arranged between the first inner surface and the second inner surface;

the wobble plate is partially encircled within the inner surface of the rotor, and includes respectively a first peripheral portion adjacent to the first inner surface, a second peripheral portion adjacent to the second inner surface and opposite to the first peripheral portion, and a wobble plate contact surface adjacent to the rotor contact surface and arranged between the first peripheral portion and the second peripheral portion;

wherein a first bearing is provided between the first inner surface and the first peripheral portion, a second bearing is provided between the second inner surface and the second peripheral portion, and a third bearing is provided between the rotor contact surface and the wobble plate contact surface; and wherein an inner ring contact surface and an outer ring contact surface of said first bearing are respectively in contact with the first inner surface and the first peripheral portion;

an inner ring contact surface and an outer ring contact surface of said second bearing are respectively in contact with the second inner surface and the second peripheral portion; and an inner ring contact surface and an outer ring contact surface of said third bearing are respectively in contact with the rotor contact surface and the wobble plate contact surface.

2. The two-way wobble plate compressor according to claim 1, wherein said first bearing and second bearing each is one of a needle roller thrust bearing, a roller pin thrust bearing, a double row needle roller thrust bearing, a double row roller pin thrust bearing, and a conical roller thrust bearing.

3. The two-way wobble plate compressor according to claim 1, wherein said third bearing is one of a radial needle roller bearing, a radial roller pin bearing, or a radial ball bearing.

4. The two-way wobble plate compressor according to claim 1, wherein a thrust washer is provided between the inner ring contact surface of said second bearing and said second surface, and between the outer ring contact surface of said second bearing and said second peripheral portion, and said third bearing is a radial ball bearing.

5. The two-way wobble plate compressor according to claim 1, wherein said two-way piston includes two socket portions, two hemispherical sliding shoes are provided within the two socket portions for interacting with the first peripheral portion and the second peripheral portion of said wobble plate, respectively.

6. A two-way wobble plate compressor, comprising:

a cylinder block, the cylinder block having a cylinder bore;

a two-way piston capable of reciprocating within the cylinder bore of the cylinder block;

a drive assembly driving the two-way piston, the drive assembly including a drive shaft, a rotor fixedly connected with the drive shaft, and an annular wobble plate fitting with the rotor, the rotor having a central plane angled to a perpendicular plane of the drive shaft, the central plane of the wobble plate being coincident with the central plane of the rotor, when the drive shaft rotates, the rotor drives the two-way piston via the wobble plate to perform reciprocating motion; characterized in that:

the rotor has an inner surface for fitting with the annular wobble plate, the inner surface including a first inner surface and a second inner surface, which are oppositely arranged, and a rotor contact surface arranged between the first inner surface and the second inner surface;

the wobble plate is partially encircled within the inner surface of the rotor, and includes respectively a first peripheral portion adjacent to the first inner surface, a second peripheral portion adjacent to the second inner surface and opposite to the first peripheral portion, and a wobble plate contact surface adjacent to the rotor contact surface and arranged between the first peripheral portion and the second peripheral portion;

wherein a first bearing is provided between the first inner surface and the first peripheral portion, a second bearing is provided between the second inner surface and the second peripheral portion, and a third bearing is provided between the rotor contact surface and the wobble plate contact surface; and wherein a thrust washer is provided between the inner ring contact surface of said first bearing and said first inner surface, and/or between the outer ring contact surface of said first bearing and said first peripheral portion; and a thrust washer is provided between the inner ring contact surface of said second bearing and said second inner surface, and/or between the outer ring contact surface of said second bearing and said second peripheral portion.

7. The two-way wobble plate compressor according to claim 6, wherein said first bearing and second bearing each is one of a needle roller thrust bearing, a roller pin thrust bearing, a double row needle roller thrust bearing, a double row roller pin thrust bearing, and a conical roller thrust bearing.

8. The two-way wobble plate compressor according to claim 6, wherein said third bearing is one of a radial needle roller bearing, a radial roller pin bearing, or a radial ball bearing.

9. The two-way wobble plate compressor according to claim 6, wherein a thrust washer is provided between the inner ring contact surface of said second bearing and said second surface, and between the outer ring contact surface of said second bearing and said second peripheral portion, and said third bearing is a radial ball bearing.

10. A two-way wobble plate compressor, comprising:

a cylinder block, the cylinder block having a cylinder bore;

a two-way piston capable of reciprocating within the cylinder bore of the cylinder block;

a drive assembly driving the two-way piston, the drive assembly including a drive shaft, a rotor fixedly connected with the drive shaft, and an annular wobble plate fitting with the rotor, the rotor having a central plane angled to a perpendicular plane of the drive shaft, the central plane of the wobble plate being coincident with the central plane of the rotor, when the drive shaft rotates, the rotor drives the two-way piston via the wobble plate to perform reciprocating motion; characterized in that:

the rotor has an inner surface for fitting with the annular wobble plate, the inner surface including a first inner surface and a second inner surface, which are oppositely arranged, and a rotor contact surface arranged between the first inner surface and the second inner surface;

the wobble plate is partially encircled within the inner surface of the rotor, and includes respectively a first peripheral portion adjacent to the first inner surface, a second peripheral portion adjacent to the second inner surface and opposite to the first peripheral portion, and a wobble plate contact surface adjacent to the rotor contact surface and arranged between the first peripheral portion and the second peripheral portion;

wherein a first bearing is provided between the first inner surface and the first peripheral portion, a second bearing is provided between the second inner surface and the second peripheral portion, and a third bearing is provided between the rotor contact surface and the wobble plate contact surface; and wherein said rotor includes a first annular flange and a second annular flange, and the first annular flange and the second annular flange are fastened together via a nut and said drive shaft.

* * * * *